United States Patent [19]

O'Neal

[11] 3,951,316

[45] Apr. 20, 1976

[54] SANITARY DRINKING SPOUT FOR LIQUID CONTAINER

[76] Inventor: Chester L. O'Neal, 101 S. Locust, Greencastle, Ind. 46135

[22] Filed: Oct. 10, 1974

[21] Appl. No.: 513,762

[52] U.S. Cl. ..... 222/529; 222/541; 220/273; 229/7 R

[51] Int. Cl.[2] ..... B67D 3/00

[58] Field of Search ..... 222/541, 527, 529–532, 222/566, 572, 574, 528; 220/273, 90.6; 229/75 R, 17 R

[56] References Cited

UNITED STATES PATENTS

| | | | |
|---|---|---|---|
| 2,444,104 | 6/1948 | Marken | 222/532 |
| 2,546,052 | 3/1951 | Wilkins | 222/529 |
| 2,772,823 | 12/1956 | Plamann | 222/541 |
| 3,154,226 | 10/1964 | Petitto | 222/529 |
| 3,477,603 | 11/1969 | Koll | 222/541 |
| 3,481,515 | 12/1969 | Booth et al. | 222/529 |
| 3,628,695 | 12/1971 | Bryant | 222/541 |

*Primary Examiner*—Robert B. Reeves
*Assistant Examiner*—H. Grant Skaggs
*Attorney, Agent, or Firm*—Woodard, Weikart, Emhardt & Naughton

[57] ABSTRACT

A sanitary drinking spout interiorly attached to a liquid container and extendable therefrom. The container includes a top wall with an aperture sealed by a tear tab. The spout includes a pair of flanges integrally attached together and spaced apart by a flexible center portion. The flanges are interiorly mounted to the top wall on opposite sides of the sealed aperture. The center portion of the spout is projectable when the aperture is opened by tearing the tab sealing the aperture closed. In one embodiment, a finger is mounted interiorly to the tear tab with the spout projecting between the finger and tear tab. Upon removal of the tear tab from the can, the finger forces the spout outwardly through the aperture. In another embodiment, a second aperture is provided on the top wall of the can for allowing air to enter the can facilitating pouring through the spout.

3 Claims, 9 Drawing Figures

SANITARY DRINKING SPOUT FOR LIQUID CONTAINER

BACKGROUND OF THE INVENTION

1. Field of the Invention

This invention is in the field of containers with spouts.

2. Description of the Prior Art

A number of containers have been provided with pouring spouts such as those disclosed in the following U.S. Patents:

3,169,678 issued to H. E. Wilkinson;

3,616,961 issued to S. C. Mallorca; and 3,628,695 issued to C. F. Bryant. Liquids such as soft drinks are provided in metal containers having pull tab type tear strips. Such a tear strip is shown in the U. S. Pat. No. 3,473,705 issued to May which also discloses a spout extendable from the can. A similar variation is shown in the U.S. Pat. No. 3,481,515 issued to Booth.

Many of the prior art spouts have been designed with the primary purpose of providing a pouring spout as compared to the sanitary drinking spout disclosed herein. My spout is mounted to the interior surface of the can and is not directly connected to the tear tab as in some of the prior art devices. Thus, by not connecting the spout directly to the tear tab, the possibility of tearing of the spout is eliminated and as a result, the spout may be produced from a wax covered paper. In addition, the spout is not connected to the can by a friction type of connection such as a hinge and instead is mounted directly to the can having a flexible portion resulting in lower costs and more reliable operations. The spout is adaptable to containers having tear drop shaped tear tabs or circular pivoting closures.

SUMMARY OF THE INVENTION

One embodiment of the present invention is a liquid containing metal can with sanitary drinking spout comprising a main body including a top wall, a bottom wall and a circular sidewall sealing joined to the top wall and the bottom wall, the top wall having an aperture sealingly closed by a tear tab, and a sanitary drinking spout including a pair of flanges and a flexible center portion integrally attached to and disposed between the flanges, the flanges being fixedly attached to the top wall on opposite sides of the aperture within the main body, the center portion being projectable through the aperture when the tab is moved to open the aperture.

It is an object of the present invention to provide a new and improved sanitary drinking spout for a liquid containing metal can.

A further object of the present invention is to provide a new and improved container with spout.

In addition, it is an object of the present invention to provide a spout mounted to a container having a flexible portion projectable through an aperture in the container.

Related objects and advantages of the present invention will be apparent from the following description.

DESCRIPTION OF THE PREFERRED EMBODIMENTS

Figure 1:
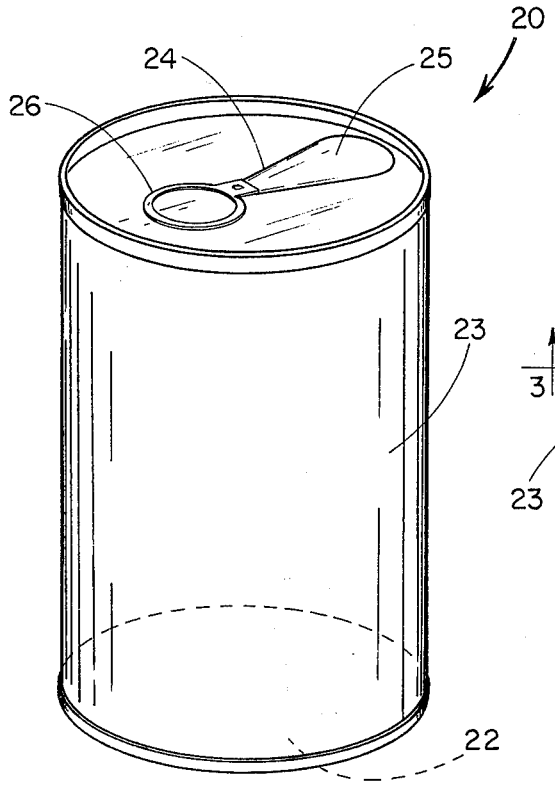
FIG. 1 is a perspective view of a container incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
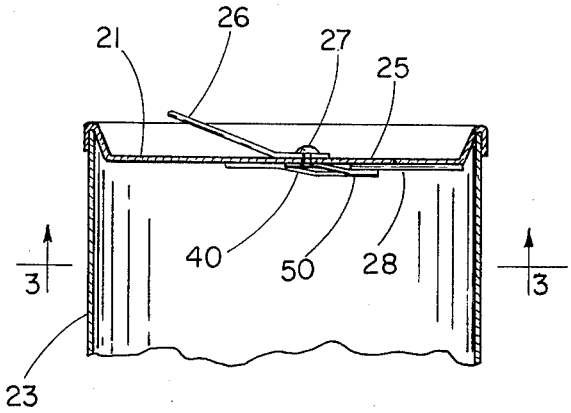
FIG. 2 is an enlarged cross sectional view of the top portion of the container of FIG. 1.

Referring now more particularly to FIGS. 1 and 2, there is shown a liquid containing metal can 20 including a main body with a top wall 21, a bottom wall 22, and a circular sidewall 23. The top and bottom wall are sealingly joined to the sidewall forming a sealed enclosure.

Top wall 21 is provided with an aperture 24 sealingly closed by a conventional removable tear strip 25. Both the aperture and tear strip are tear drop shaped. A ring tab 26 is attached by fastener 27 to one end of tab 25 thereby allowing the consumer to pull the ring and remove the tear strip from the top wall of the can for the pouring of the liquid therefrom.

Figure 3:
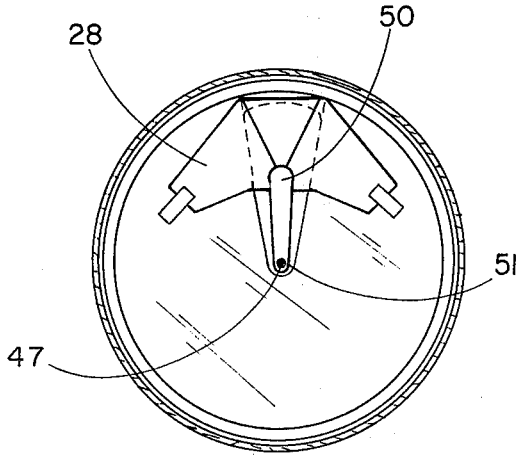
FIG. 3 is a cross sectional view taken along the line 3—3 of FIG. 2 and viewed in the direction of the arrows.
Figure 5:
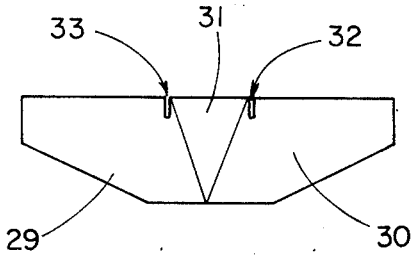
FIG. 5 is a plan view of the spout shown prior to mounting to the top wall of the container of FIG. 4.
Figure 6:
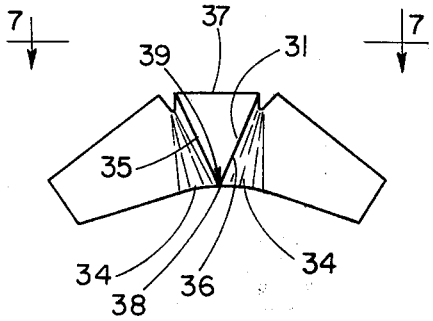
FIG. 6 is an enlarged view of the spout shown in FIG. 5 prior to mounting to the container.

A sanitary drinking spout 28 is mounted to the interior surface of top wall 21 and is projectable through aperture 24 once the tear tab is removed from the can. The spout 28 is shown in FIG. 5 prior to the mounting of the spout to the can. The spout includes a pair of flanges 29 and 30 integrally joined together and spaced apart by a flexible center portion 31. A pair of notches 32 and 33 are provided separating the flanges 29 and 30 from the center portion and allowing the flanges to be bent along a plurality of crease lines 34 (FIG. 6) to provide a more compact pouring spout for mounting to the top wall of the can as shown in FIGS. 2 and 3. The crease lines 34 extend across the flanges from each notch. The notches and crease lines allow the center portion to be movable with respect to the flanges. The center portion 31 has a flat triangular center formed by fold lines 35, 36 and edge 37. The fold lines 35 and 36 converge from edge 37 toward edge 38 to vertex 39. As a result, the center portion may be projectable through aperture 24 when the tab is moved to open the aperture.

Figure 4:
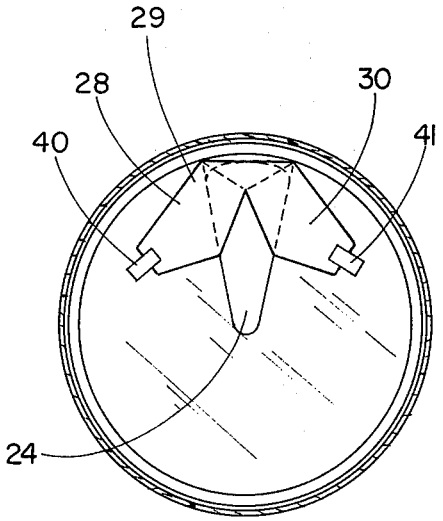
FIG. 4 is the same view as FIG. 3 only with the tear tab removed and the spout projecting through the top wall of the container.
Figure 7:
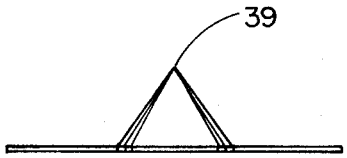
FIG. 7 is an end view of the spout looking in the direction of arrows 7—7 of FIG. 6.

Flanges 29 and 30 are fixedly attached to the interior surface of top wall 21 on opposite sides of aperture 24. The flanges may be secured to the top wall of the can by means such as adhesives. In addition, a pair of retainers 40 and 41 (FIG. 4) may be fixedly mounted to the interior surface of top wall 21 with the retainers engaging the flanges forcing the flanges against the top wall. The center portion of the spout is shown in the extended position in FIG. 7. Likewise, the spout is shown extending through aperture 24 in FIG. 4.

In the embodiment shown in FIGS. 1 through 4, a finger 50 having a cone-shaped configuration has one end 51 fixedly attached to fastener 47. The finger is cantileveredly mounted with spout 28 extending between finger 50 and tab 25. Thus, by pulling ring 26 and removing the tear tab 25 from the can, finger 50 forces the center portion of the pouring spout 28 to extend through aperture 24.

Figure 8:
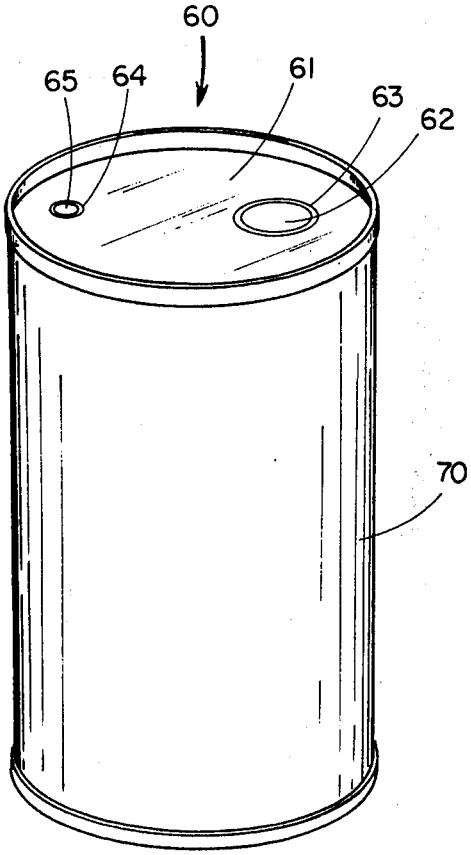
FIG. 8 is a perspective view of an alternate container using the present invention.
Figure 9:
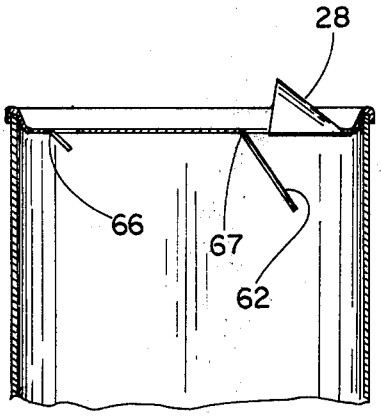
FIG. 9 is an enlarged cross sectional view of the top portion of the container of FIG. 8.

Another embodiment of a liquid containing can is shown in FIGS. 8 and 9. Can 60 includes a top wall 61 having a large aperture 63 and a smaller aperture 64. Both apertures are sealingly closed by a pair of covers 62 and 65 pivotally mounted respectively at ends 67 and 66 to the top wall. Cover 65 is punched inwardly providing an air hole in the top wall whereas cover 62 is punched inwardly allowing the liquid therein to be poured from the can. In the embodiment of the cam 60 presently on the market, cover 62 is pivotally mounted to the top wall adjacent to the sidewall 70 of the can in lieu of between apertures 63 and 64 as shown in FIG. 9. Cover 62 is pivotally mounted at end 67 between the two apertures in order to facilitate the mounting of the pouring spout 28 which is identical to the spout previously described.

It will be obvious from the above description that the present invention provides a new and improved sanitary drinking spout for a liquid contained can. The spout may be produced from wax paper or plastic and may be glued to the bottom surface of the top wall or by other suitable means. For example, the spout may be clamped to the top wall of the spout by a metal lip extending around the periphery of the aperture.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A liquid containing metal can with sanitary drinking spout comprising:

a main body including a top wall with a circumferentially extending edge portion, a bottom wall and a circular sidewall sealing joined to said top wall and said bottom wall, said top wall having an aperture sealingly closed by a tear tab;

a pull attached to said tear tab;

a sanitary drinking spout including a pair of flanges and a flexible center portion integrally attached to and disposed between said flanges, said flanges being fixedly attached to said top wall on opposite sides of said aperture within said main body, said center portion having a base located adjacent said edge portion of said top wall, said center portion being projectable through said aperture when said tab is moved to open said aperture;

said spout including a plurality of crease lines extending across said flanges allowing said center portion to be movable with respect to said flanges;

a finger cantileveredly attached to said tear tab at the location of attachment of said pull to said tear tab, said finger projecting from said location of attachment toward said edge portion of said top wall and being positioned in said can with said spout projecting between said top wall and said finger, said spout being pulled through said aperture by said finger and pivoted with said finger about said base as said tab is torn from said can in a direction from said location of attachment toward said base.

2. The can of claim 1 and further comprising:

a pair of retainers fixedly mounted to said top wall within said can, said retainers engaging said flanges and forcing said flanges against said wall.

3. The can of claim 2 wherein:

said spout includes a pair of notches disposed between said center portion and said flanges, said spout further includes a plurality of crease lines extending across said flanges from each of said notches allowing said center line to be movable with respect to said flanges.

* * * * *